US005465700A

United States Patent [19]

Nishimoto

[11] Patent Number: 5,465,700

[45] Date of Patent: Nov. 14, 1995

[54] FUEL INJECTION DEVICE FOR AN ENGINE WITH OPTIMIZED CONTROL OF A FUEL INJECTION AMOUNT AFTER ACCELERATION

[75] Inventor: Koji Nishimoto, Hyogo, Japan

[73] Assignee: Mitsubishi Denki Kabushiki Kaisha, Tokyo, Japan

[21] Appl. No.: 194,057

[22] Filed: Feb. 9, 1994

[30] Foreign Application Priority Data

May 31, 1993 [JP] Japan ..... 5-129025

[51] Int. Cl.[6] ..... F02D 41/10

[52] U.S. Cl. ..... 123/492

[58] Field of Search ..... 123/492, 493

[56] References Cited

U.S. PATENT DOCUMENTS 4,984,552 1/1991 Nishizawa et al. ..... 123/492

FOREIGN PATENT DOCUMENTS 62-46690 10/1987 Japan .
55336 3/1988 Japan ..... 123/492
140837 6/1988 Japan ..... 123/492
275036 11/1990 Japan ..... 123/492

*Primary Examiner*—Tony M. Argenbright
*Attorney, Agent, or Firm*—Sughrue, Mion, Zinn, Macpeak & Seas; Richard C. Turner; Marie-Claire Boisvert

[57] ABSTRACT

When it is judged that an engine is in an acceleration state of a degree higher than a predetermined level, a fuel injection amount is increased at a rate in accordance with the detected degree of acceleration. After the end of the acceleration, the fuel injection amount is decreased with a decreasing gradient that is set in accordance with the detected degree of acceleration so as to be larger when the detected degree of acceleration is higher.

6 Claims, 13 Drawing Sheets

FUEL INJECTION DEVICE FOR AN ENGINE WITH OPTIMIZED CONTROL OF A FUEL INJECTION AMOUNT AFTER ACCELERATION

BACKGROUND OF THE INVENTION

The present invention relates to a device for controlling the amount of fuel supplied to an engine of an automobile etc. and, more specifically, to control of a fuel injection amount for acceleration in an engine having an electronically controlled fuel injection device or the like.

FIG. 11 shows constitution of a conventional fuel injection device for an engine disclosed, for instance, in Japanese Patent Application Examined Publication No. Sho. 62-46690. In FIG. 11, reference numeral 1 denotes an engine; 2, an intake pipe connected to the engine 1; and 3, a pressure sensor for detecting the internal pressure of the intake pipe 2. The output of the pressure sensor 3 is sent to an A/D converter 91 of a control section 9. Further, reference numeral 4 denotes a throttle valve provided in the intake pipe 2;5, a throttle sensor for detecting the opening degree of the throttle valve 4; 6, a cooling water temperature sensor for detecting the warming up state of the engine 1; and 7, an injector provided in the vicinity of each cylinder intake port of the intake pipe 2. Fuel, whose pressure has been adjusted to be constant, is supplied by pressure to the injector 7. Reference numeral 8 denotes a rotary sensor for detecting the rotation of the engine 1 in the form of pulses. The output of the rotary sensor 8 is sent to an input circuit 92 of the control section 9.

The control section 9 calculates a necessary fuel injection amount based on the outputs of the pressure sensor 3, rotary sensor 8, etc., and generates pulses in accordance with the fuel injection amount thus calculated. The injector 7 is driven based on the width of those pulses. More specifically, in the control section 9, the A/D converter 91 converts the analog signals from the pressure sensor 3, throttle sensor 5, etc. to digital data, which are sent to a microprocessor 93. The input circuit 92 level-converts the pulse signal from the rotary sensor 8. The output of the input circuit 92 is also sent to the microprocessor 93. Based on those digital data and pulse signal, the microprocessor 93 calculates the amount of fuel to be supplied to the engine 1 and generates the pulses for driving the injector 7, the width of those pulses being in accordance with the calculated fuel amount.

A control procedure of the microprocessor 93 and various data are stored in a ROM 94 in advance. A RAM 95 temporarily stores data generated in the process of calculations by the microprocessor 93. An output circuit 96 drives the injector 7 in accordance with the output of the microprocessor 93. Reference numeral 10 denotes an intake air temperature sensor for the engine 1.

Next, the operation of the above fuel injection device will be described. FIGS. 12 and 13 constitute a flowchart showing the operation of the control section 9 in FIG. 11, which flowchart is directed to the case of acceleration. A program stored in the ROM 94 is so constructed as to make the microprocessor 93 execute a timer routine 200 at predetermined intervals even when it is executing a main routine. In step 201 of the timer routine 200, the microprocessor 93 takes in an A/D-converted value THP indicating a latest throttle position from the RAM 95. In step 202, the microprocessor 93 takes in, from the RAM 95, an A/D-converted value THP' indicating a throttle position when the timer routine 200 was previously executed. In step 203, the latest value THP is stored into the RAM 95 as THP'. In step 204, a calculation of ΔTHP=THP−THP' is performed, where ΔTHP means a variation of the throttle position in a predetermined interval.

In step 206, ΔTHP is compared in magnitude with a judgment constant Ka for acceleration that is predetermined for the engine. If ΔTHP is larger than or equal to the constant Ka, the process goes to step 207, where a logical flow control flag A is set at 0. If ΔTHP is smaller than Ka, the logical flow control flag A is set at 1 in step 212 and a fuel injection amount correction coefficient AEWA is set at 0 in step 213. Then, the process goes to step 209, where a coefficient $AEW_0$ is calculated by applying, to ΔTHP, a cooling water temperature correction, an intake air temperature correction and an atmospheric pressure correction using an atmospheric pressure sensor (not shown). More specifically, ΔTHP is multiplied by a correction coefficient f(THW) for a cooling water temperature, a correction coefficient f(THA) for an intake air temperature THA and a correction coefficient f(Pa) for an atmospheric pressure Pa.

Then, the process goes to step 214. If the logical flow control flag A is 0, the process goes to step 215, where $AEW_2$ is calculated by adding AEWA that is stored in the RAM 95 to $AEW_0$. Then, the process goes to step 216. If the logical flow control flag A is not 0 in step 214, the process directly goes to step 216, where a coefficient $AEW_3$ is calculated by subtracting from $AEW_2$ a subtraction constant DAEW that is predetermined in accordance with performance and characteristics of the engine. In step 218, it is judged whether $AEW_3$ is positive or not. If it is positive, the process directly goes to step 221, where $AEW_3$ is stored into the RAM 95 as the fuel injection amount correction coefficient AEWA for acceleration that has been calculated this time. If $AEW_3$ is judged to be negative or zero in step 218, it is set at 0 in step 219. The execution of the timer routine 200 is finished in step 222.

On the other hand, in a fuel injection pulse width calculation routine (not shown), a basic fuel injection pulse width Tp, which is determined based on the speed of engine rotation and the internal pressure of the intake pipe 2 in accordance with the state of the logical flow control flag A, is corrected by multiplying it by (1+AEWA).

In the conventional electronically controlled fuel injection device for an engine, in calculating the fuel injection amount correction coefficient AEWA, the subtraction is performed using only the single predetermined subtraction constant DAEW, which is a fixed value. Therefore, after the fuel injection amount correction coefficient AEWA reaches a maximum, a time constant of its decrease has a decreasing pattern of first-order lag. For example, if the subtraction constant DAEW is determined for slow acceleration, after quick acceleration (during which the fuel injection amount correction coefficient AEWA is large) it will take long time for AEWA to return to zero from a time point close to the end of the acceleration. This will cause a problem that the air-fuel ratio deviates from an optimum value during a certain period after the acceleration.

Further, where the fuel evaporation is dominated by two components (low and high boiling point components) and is effectively determined by two time constants, the single subtraction constant DAEW cannot provide control of the decreasing pattern of the correction coefficient such that two time constants, i.e., two gradients are involved. This will cause a problem that the air-fuel ratio deviates from an optimum value during a certain period after acceleration, to deteriorate a driver's feeling of acceleration.

SUMMARY OF THE INVENTION

An object of the present invention is to provide an electronically controlled fuel injection device for an engine which can control a decreasing pattern of a fuel injection amount correction coefficient so as to involve two or more time constants, i.e., two or more gradients, to thereby optimize the air-fuel ratio during a certain period after acceleration.

According to the invention, an electronically controlled fuel injection device for an engine comprises:

first judging means for judging whether the engine is in an acceleration state of a degree higher than a predetermined degree;

means for increasing a fuel injection amount at a rate in accordance with the degree of acceleration when the first judging means judges that the engine is in the acceleration state of the degree higher than the predetermined degree; and means for decreasing the fuel injection amount from a level of an end of the acceleration state with a decreasing gradient that is set in accordance with the degree of acceleration so as to be larger when the acceleration degree is higher.

DESCRIPTION OF THE PREFERRED EMBODIMENTS

Embodiment 1

Figure 11:
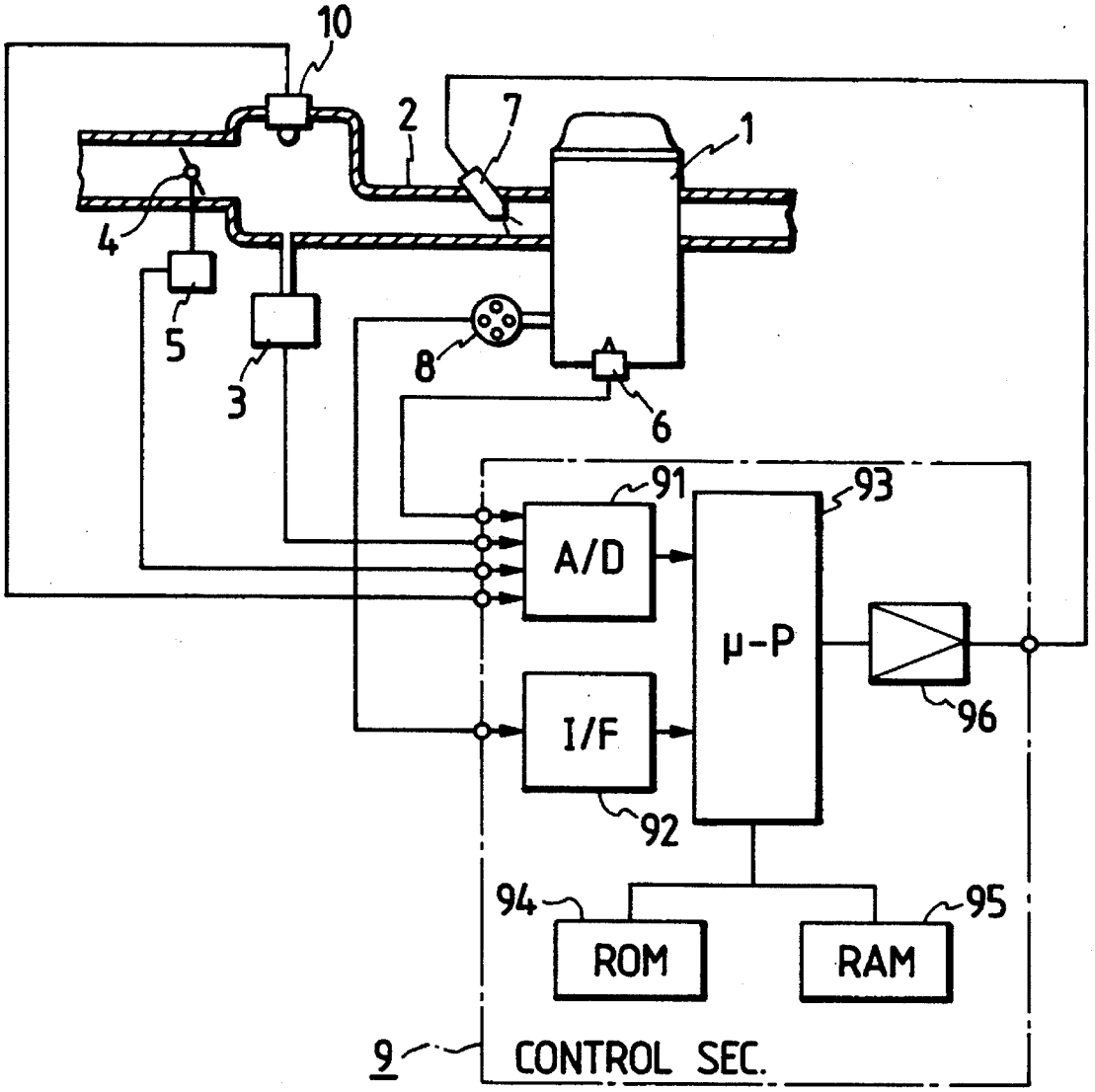
FIG. 11 PRIOR ART
FIG. 11 is a block diagram showing a conventional fuel injection device for an engine.
Figure 12:
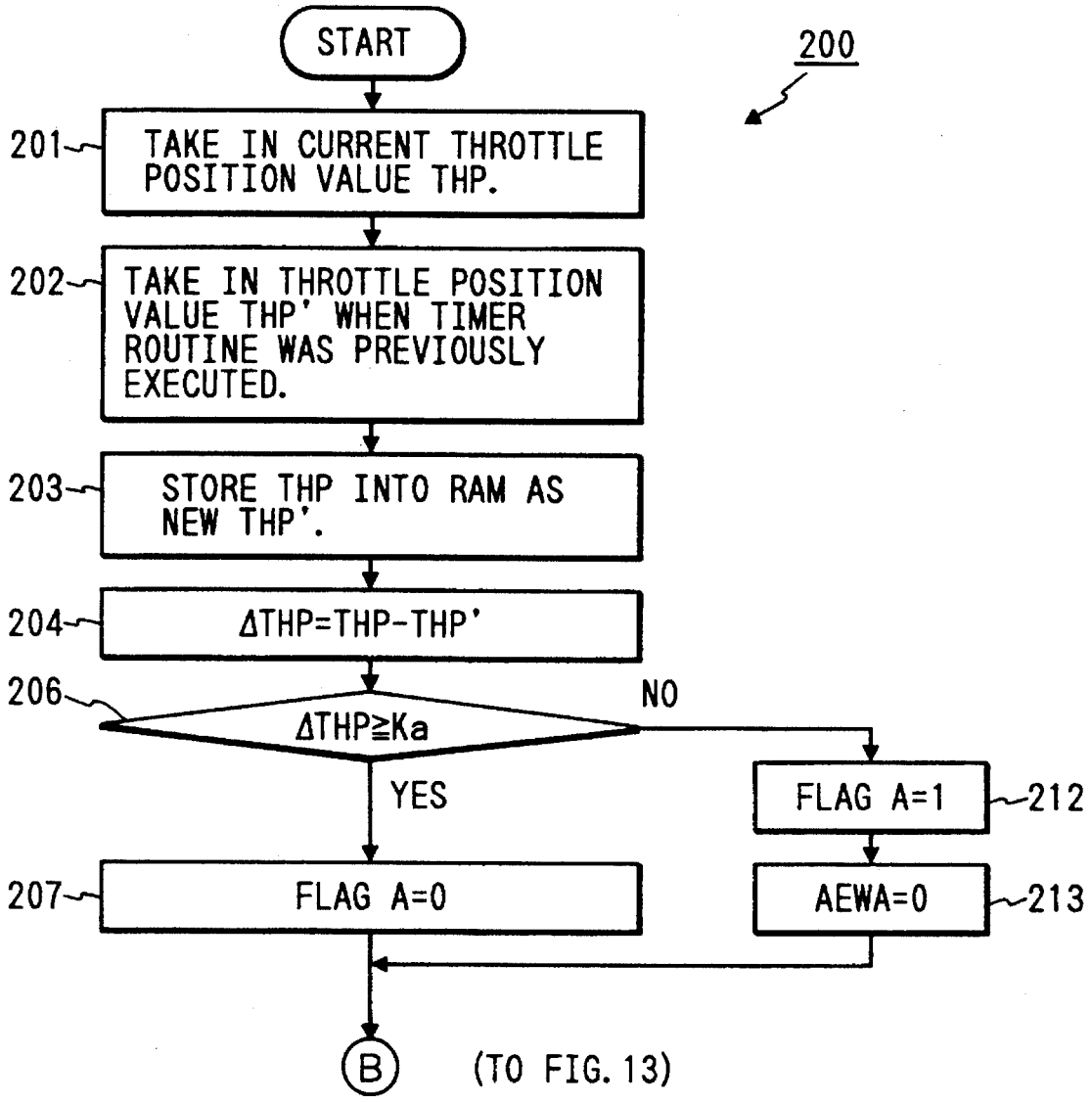
FIG. 12 PRIOR ART
FIGS. 12 and 13 constitute a flowchart showing a timer routine performed by a control section of the conventional fuel injection device of FIG. 11.
Figure 13:
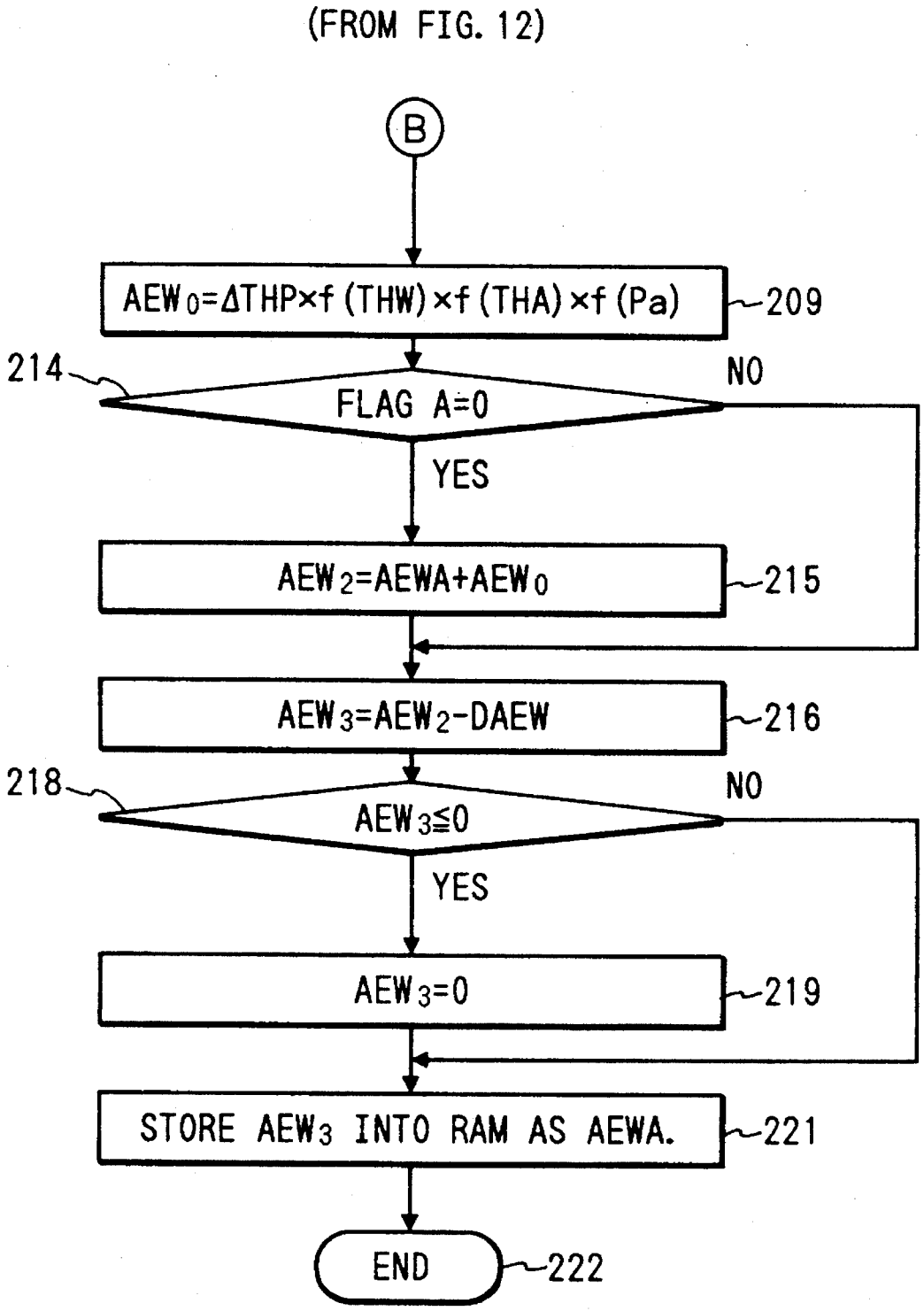
FIG. 13 PRIOR ART

A fuel injection device according to a first embodiment of the present invention will be hereinafter described with reference to FIGS. 1–6. The first embodiment has the same device constitution as the conventional device of FIG. 11 except a control section 9'. The operation of the control section 9' will be described using flowcharts of FIGS. 1–4.

Figure 1:
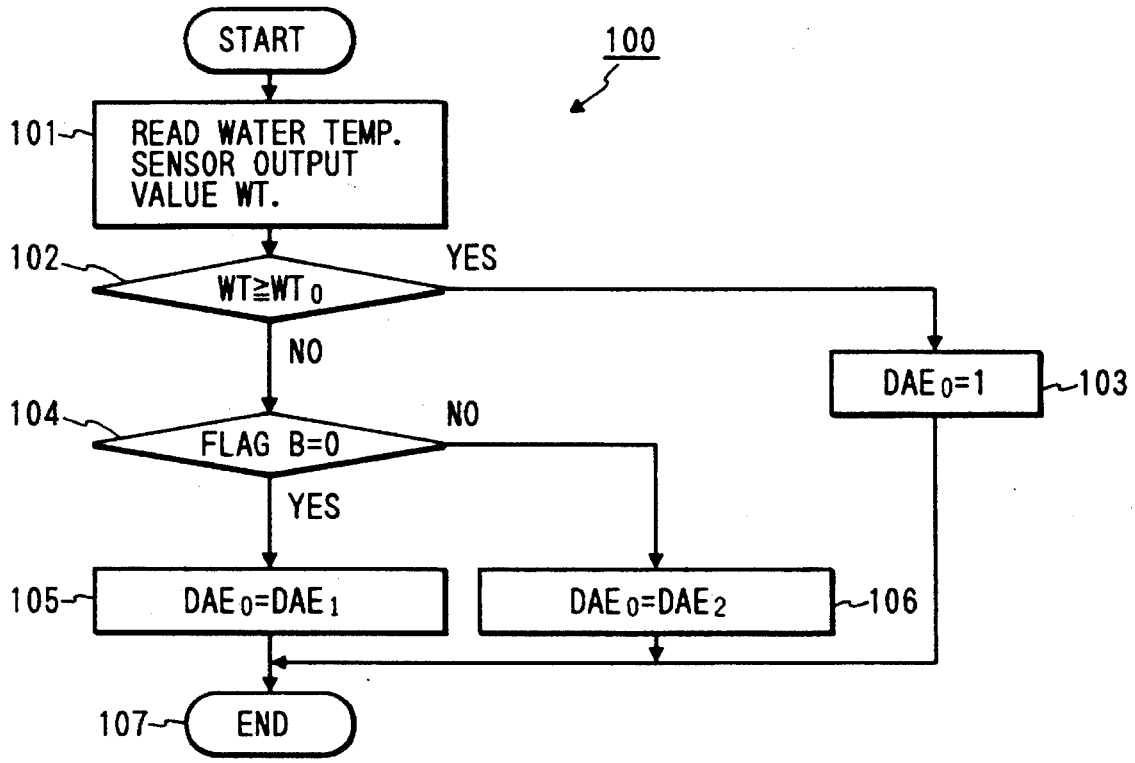
FIG. 1 is a flowchart showing a main routine to be performed by a control section of a fuel injection device for an engine according to a first embodiment of the present invention.

A program stored in the ROM 94 is constituted such that the microprocessor 93 executes a predetermined crank angle routine 300 for each predetermined crank angle during execution of a main routine. FIG. 1 shows the main routine. In step 101, the processor 93 reads a water temperature sensor output value WT. In step 102, the processor 93 judges whether WT is larger than or equal to a preset value $WT_0$. If the judgment is affirmative, the process goes to 103. After $DAE_0$ is set at 1 in step 103, the process is finished. If the judgment in step 102 is negative, the process goes to step 104. If it is judged in step 104 that a quick acceleration judgment flag B (which is set in an interruption processing routine (described below)) is 0, meaning quick acceleration, the process goes to step 105. After $DAE_1$ is set for $DAE_0$ in step 105, the process is finished. If the flag B is judged to be 1 (meaning slow acceleration) in step 104, the process goes to step 106. After $DAE_2$ is set for $DAE_0$ in step 106, the process is finished.

Figure 2:
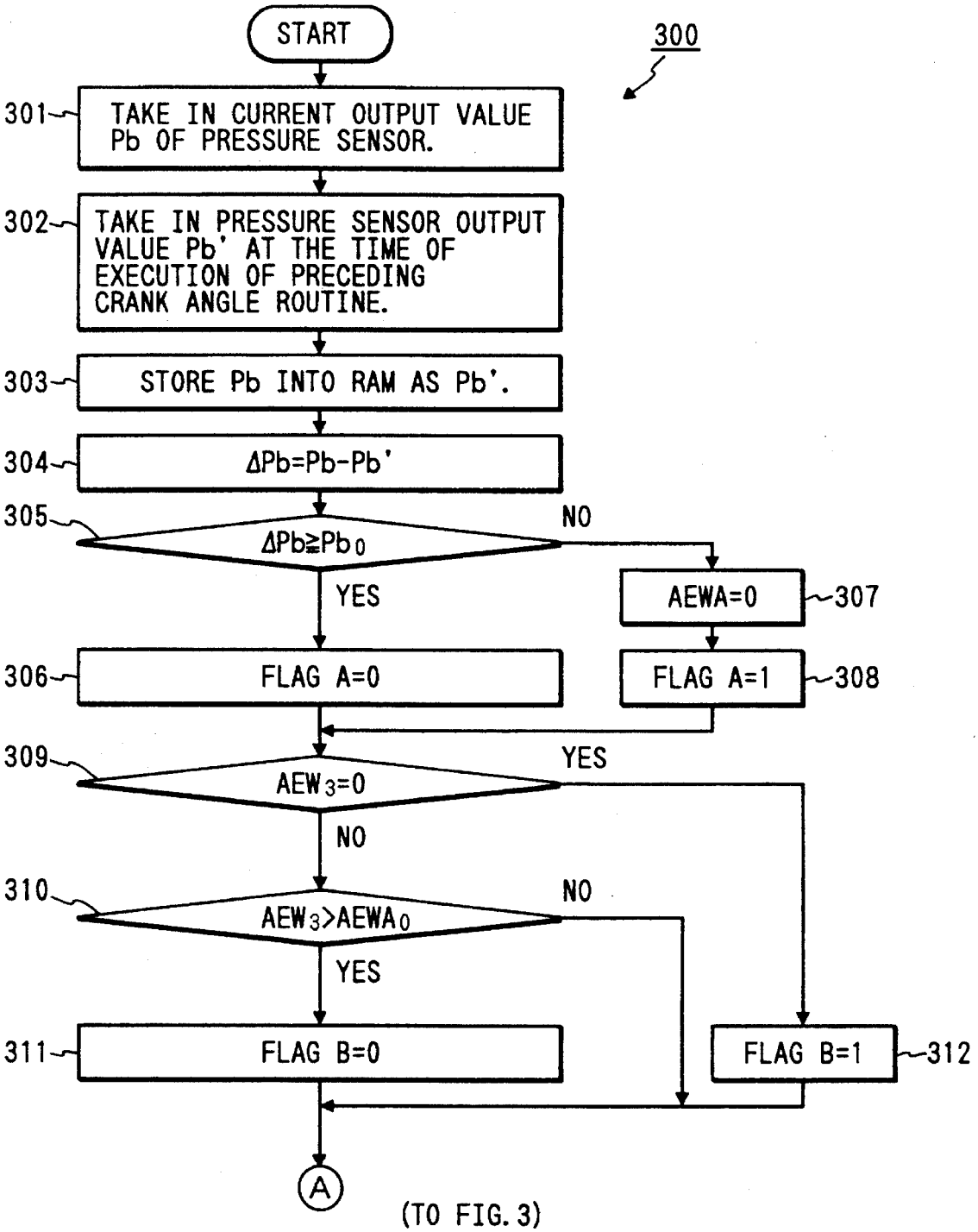
FIGS. 2–4 constitute a flowchart showing a predetermined crank angle routine to be performed by the control device in the first embodiment.
Figure 3:
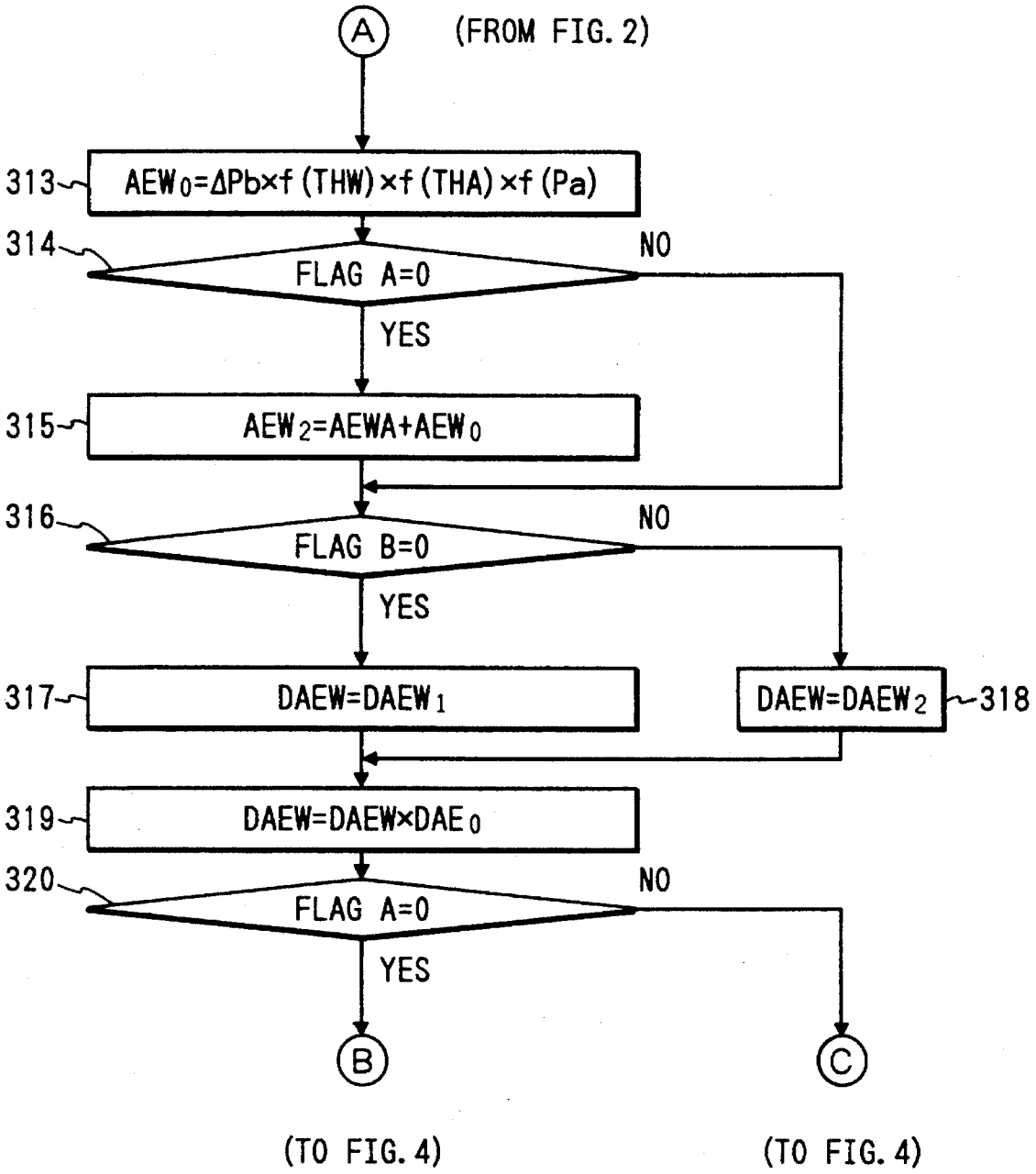
Figure 4:
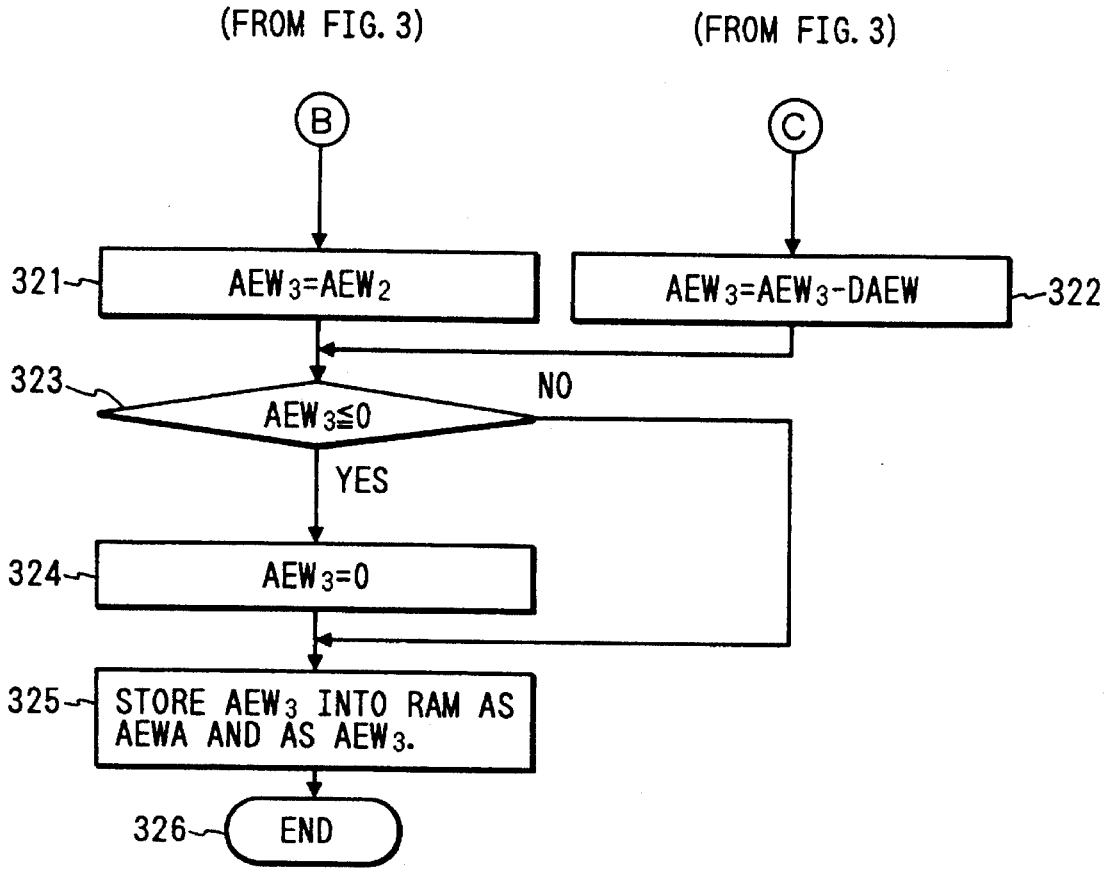

The interruption processing routine for each predetermined crank angle will be described with reference to FIGS. 2–4. In this embodiment, a variation ΔPb of the internal pressure of the intake pipe 2 is used rather than the variation ΔTHP of the throttle position in the predetermined interval that is used in the conventional device. In step 301, the microprocessor 93 takes in an output value of the pressure sensor 3 which detects an internal pressure Pb of the intake pipe 2. In step 302, the microprocessor 93 takes in, from the RAM 95, an output value Pb' of the pressure sensor 3 at the time of the preceding execution of the predetermined crank angle routine 300. In step 303, new Pb is stored into the RAM 95 as Pb'. In step 304, the variation ΔPb of the internal pressure of the intake pipe 2 for a predetermined crank angle interval is calculated according to an equation ΔPb=Pb–Pb'. In step 305, ΔPb is compared in magnitude with a judgment constant $Pb_0$ for acceleration that is predetermined in accordance with the engine. If ΔPb is larger than or equal to $Pb_0$, the process goes to step 306, where a logical flow control flag A is set at 0. If Pb is smaller than $Pb_0$, a fuel injection amount correction coefficient AEWA is set at 0 in step 307 and the logical flow control flag A is set at 1 in step 308. Then, the process goes to step 309.

In step 309, it is judged whether a fuel injection amount correction coefficient $AEW_3$ is 0. If the judgment is affirmative, the process goes to step 312. After the flag B is set at 1 in step 312, the process goes to step 313. If the judgment in step 309 is negative, the process goes to step 310, where it is judged whether $AEW_3$ is larger than a preset value $AEWA_0$. If the judgment in step 310 is affirmative, which means quick acceleration, the process goes to step 311. After the flag B is set at 0 in step 311, the process goes to step 313. If the judgment in step 310 is negative, which means slow acceleration, the process goes to step 313 without performing an operation relating to the flag B.

In step 313, $AEW_0$ is calculated by multiplying ΔPb by a cooling water correction coefficient f(THW), an intake air temperature correction coefficient f(THA) and an atmospheric pressure correction coefficient f(Pa). In step 314, it is judged whether the logical flow control flag A is 0. If the judgment is affirmative, which means that the engine is in an acceleration state, the process goes to step 315, where $AEW_2$ is calculated by adding AEWA to $AEW_0$. If the judgment in step 314 is negative, the process directly goes to step 316.

In step 316, it is judged based on the value of the flag B whether the engine in a quick or slow acceleration state, If the flag B is judged to be 0, which means quick acceleration, the process goes to step 317, where a first subtraction constant $DAEW_1$, which is predetermined in accordance with injection fuel transport characteristics in the intake pipe 2, is substituted into a subtraction constant DAEW. On the other hand, if the flag B is judged to be not 0 in step 316, which means slow acceleration, the process goes to step 318, where a second subtraction coefficient $DAEW_2$, which is predetermined in the same manner as $DAEW_1$ is substituted into the subtraction constant DAEW. The constants $DAEW_1$ and $DAEW_2$ are predetermined such that $DAEW_l > DAEW_2$. Where the second subtraction coefficient $DAEW_2$ is used, the subtraction gradient is gentler than the case of using the first subtraction coefficient $DAEW_l$.

In step 320, it is judged whether the logical flow control flag A is 0. If the judgment is affirmative, which means that the increase ΔPb of the internal pressure of the intake pipe 2 is larger than or equal to the predetermined value $Pb_0$ and therefore the engine is in an acceleration state, $AEW_2$ mentioned above is substituted into $AEW_3$ in step 321. If the judgment is step 320 is negative, which means that the engine is not in an acceleration state, $AEW_3$ stored in the RAM 95 in the preceding execution of the predetermined crank angle routine 300 minus the subtraction constant DAEW is substituted into $AEW_3$ in step 322. Then, the process goes to step 323, where it is judged whether $AEW_3$ is zero or negative. If $AEW_3$ is zero or negative, $AEW_3$ is set at 0 in step 324 and the process goes to step 325. If $AEW_3$ is judged to be positive in step 323, the process directly goes to step 325, where $AEW_3$ is stored into the RAM 95 as the fuel injection amount correction coefficient AEWA and as $AEW_3$ itself. Then, the execution of the predetermined crank angle routine 300 is finished in step 326.

On the other hand, in a fuel injection pulse width calculation routine (not shown), a basic fuel injection pulse width Tp, which is determined based on the speed of engine rotation and the internal pressure of the intake pipe 2 in accordance with the state of the logical flow control flag A, is corrected by multiplying it by (1+AEWA).

Figure 5A:
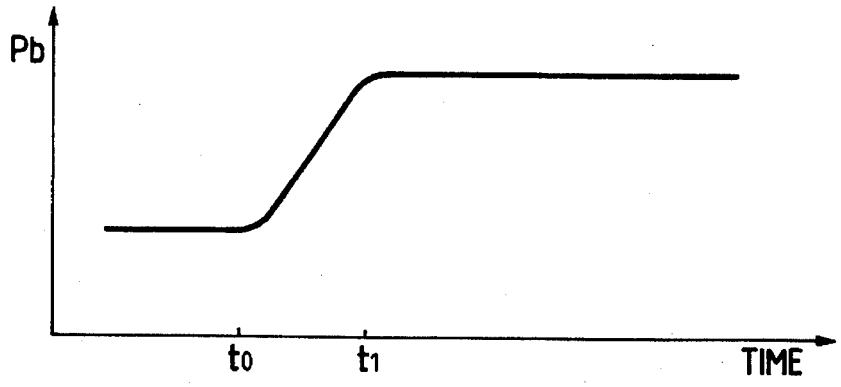
FIGS. 5(*a*)–5(*c*) are graphs showing a fuel injection control operation for quick acceleration in the first embodiment.
Figure 5B:
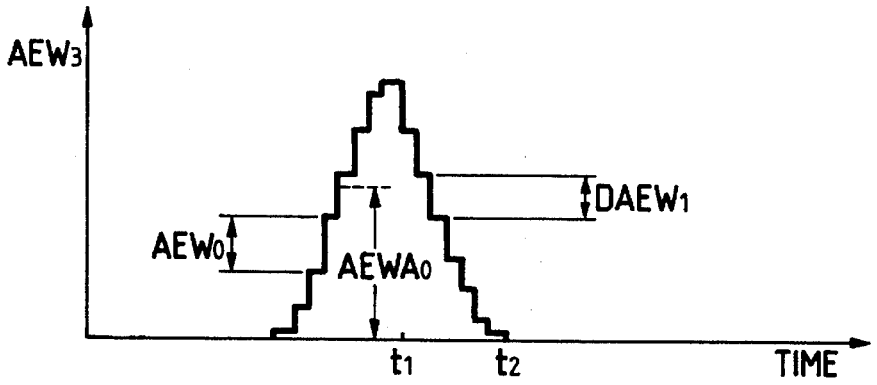
Figure 5C:
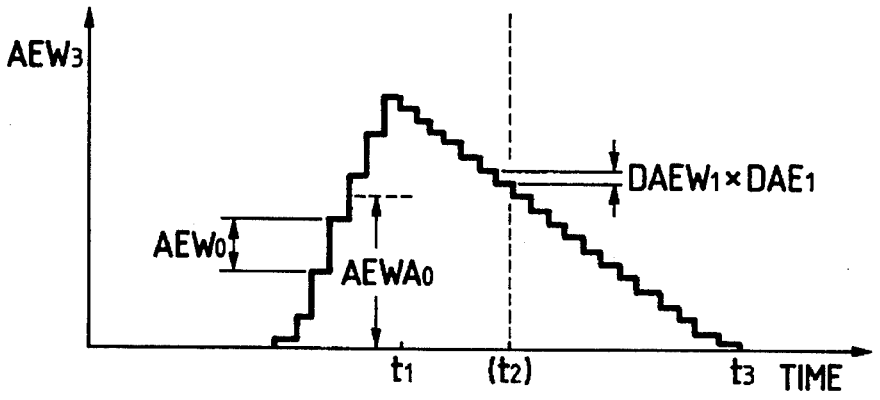

FIGS. 5(*a*)–5(*c*) and 6(*a*)–6(*c*) show how the actual engine operates in an acceleration state by the execution of the flowcharts described above. FIG. 5(*a*) shows the internal pressure Pb of the intake pipe 2 in quick acceleration, FIG. 5(*b*) shows the correction coefficient $AEW_3$ in quick acceleration at a high temperature, and FIG. 5(*c*) shows the correction coefficient $AEW_3$ in quick acceleration at a low temperature.

A description will be made of FIG. 5(*b*). During acceleration, i.e., from $t_0$ to $t_1$, the correction coefficient $AEW_3$ is increased by a step of $AEW_0$ for each predetermined crank angle. At time $t_1$, it is judged that the variation ΔPb of the internal pressure of the intake pipe 2 is smaller than the predetermined value $Pb_0$, which means that the engine is not in an acceleration state. Since at this instant $AEW_3$ is larger than $AEW_0$ and the engine cooling water temperature is high, $DAE_0$ is equal to 1. Thus, until time $t_2$ a subtracting operation is performed by a step of the first subtraction constant $DAEW_1$ for each predetermined crank angle. A similar operation is performed in the case of FIG. 5(*c*). Since in this case the engine cooling water temperature is low, $DAE_0$ is equal to $DAE_l$. Until time $t_3$ a subtracting operation is performed by a step of the first subtraction constant $DAEW_1$ multiplied by $DAE_1$. Since $DAE_1$ is smaller than 1, a period $(t_3-t_1)$ is longer than a period $(t_2-t_1)$.

Figure 6A:
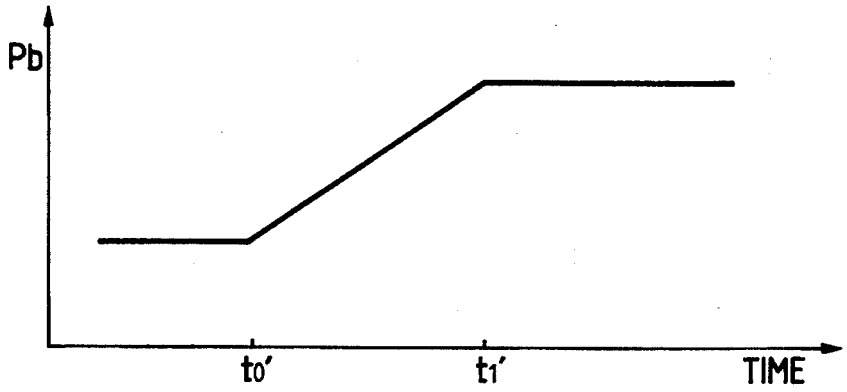
FIGS. 6(*a*)–6(*c*) are graphs showing a fuel injection control operation for slow acceleration in the first embodiment.
Figure 6B:
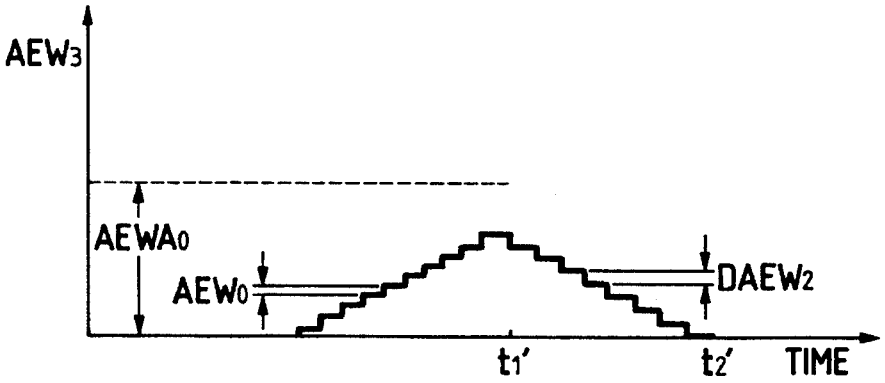
Figure 6C:
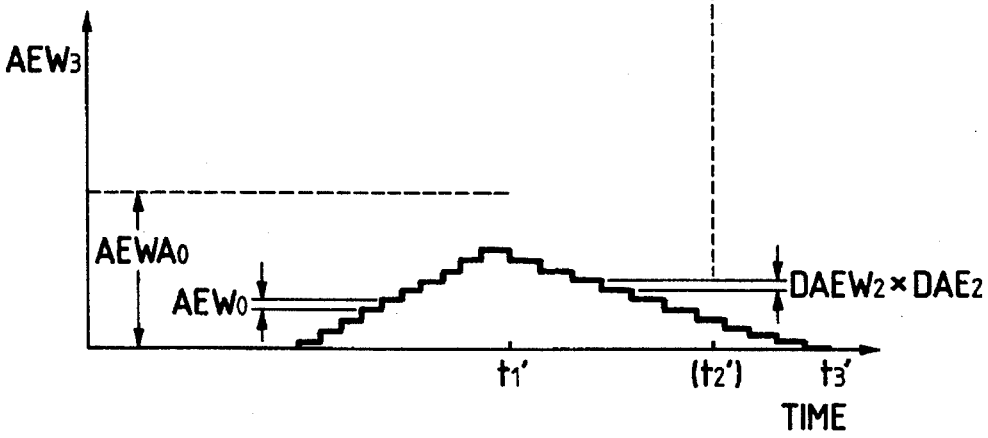

FIG. 6(*a*) shows the internal pressure Pb of the intake pipe 2 in slow acceleration, FIG. 6(*b*) shows the correction coefficient $AEW_3$ in slow acceleration at a high temperature, and FIG. 5(*c*) shows the correction coefficient $AEW_3$ in slow acceleration at a low temperature.

A description will be made of FIG. 6(*b*). During acceleration, i.e., from $t_0'$ to $t_1'$, the correction coefficient $AEW_3$ is increased by a step of $AEW_0$ for each predetermined crank angle. At time $t_1'$, it is judged that the variation ΔPb of the internal pressure of the intake pipe 2 is smaller than the predetermined value $Pb_0$, which means that the engine is not in an acceleration state. Since at this instant $AEW_3$ is smaller than $AEW_0$ and the engine cooling water temperature is high, $DAE_0$ is equal to 1. Thus, until time $t_2'$ a subtracting operation is performed by a step of the second subtraction constant $DAEW_1$ for each predetermined crank angle. A similar operation is performed in the case of FIG. 6(*c*). Since in this case the engine cooling water temperature is low, $DAE_0$ is equal to $DAE_2$. Until time $t_3'$ a subtracting operation is performed by a step of the first subtraction constant $DAEW_2$ multiplied by $DAE_2$.

In this embodiment, since settings are made such that $DAEW_1 > DAEW_2$, $0 < DAE_1 < DAE_2 < 1$, the periods from the ends of acceleration, $t_1$ and $t_1'$, to the times when the corrective injection fuel amount becomes zero, $t_2$ and $t_2'$, satisfy a relationship $(t_2-t_1) < (t_2'-t_1')$. That is, the increased fuel reducing period after the end of quick acceleration can be shortened. An optimum acceleration fuel correction period can be obtained over a wide range including both quick and slow acceleration, to provide an optimum air-fuel ratio.

In a low-temperature operation, the fuel sticking amount and the evaporation ratio in the intake pipe 2 depend on the surface temperatures of the inner wall of the intake pipe 2 and the intake valve. Therefore, by setting the temperature-dependent subtraction coefficients for quick acceleration and slow acceleration such that $DAE_1 < DAE_2$, the increased fuel reducing periods for acceleration at high and low temperatures can satisfy a relationship $(t_3-t_2) > (t_3'-t_2')$. In each case, the subtraction calculating period for the injection amount correction coefficient coincides with the period required for the sticking fuel amount to reach a steady state. Even in slow acceleration at a low temperature, it is possible to prevent such a case that the increased fuel reducing period after the end of acceleration becomes excessively long, which is very advantageous.

Embodiment 2

Figure 7A:
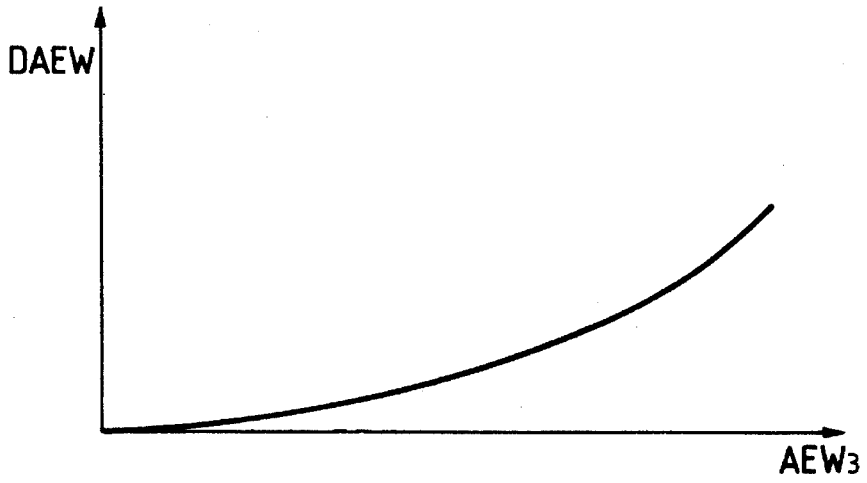
FIGS. 7(*a*) and 7(*b*) are graphs showing a fuel injection control operation in a second embodiment.
Figure 7B:
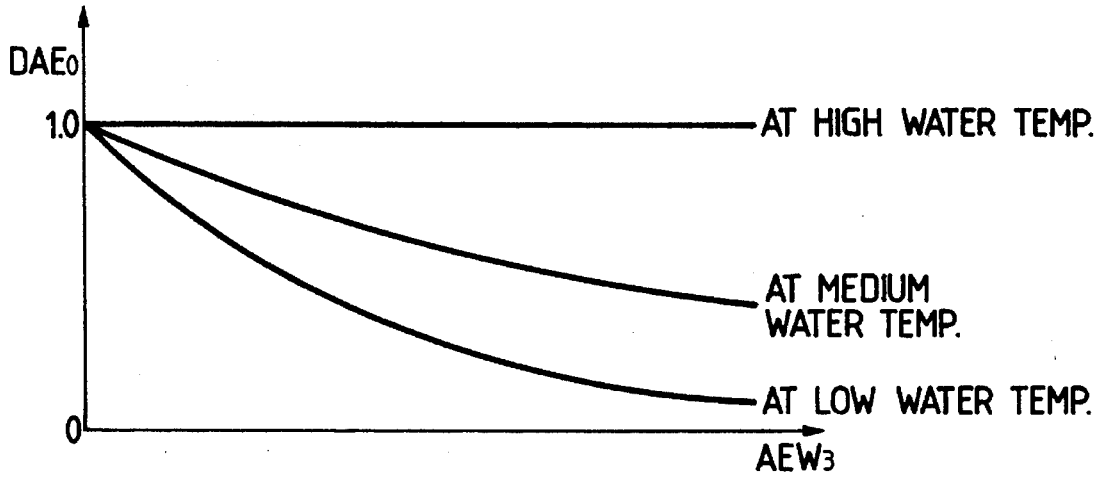

In the above-described first embodiment, by use of the quick acceleration judgment means the constant DAEW representing the decreasing gradient after the end of acceleration is set at the first value for quick acceleration and at the second value for slow acceleration. Further, the coefficient $DAE_0$ for correcting the decreasing gradient in accordance with the engine temperature is switched between the values for quick acceleration and slow acceleration. In a second embodiment, as shown in FIGS. 7(*a*) and 7(*b*), DAEW and $DAE_0$ are set in a continuous manner in accordance with the degree of acceleration, more specifically, the fuel injection amount correction coefficient for acceleration $AEW_3$. The second embodiment can provide the same advantages as the first embodiment.

Embodiment 3

Figure 8:
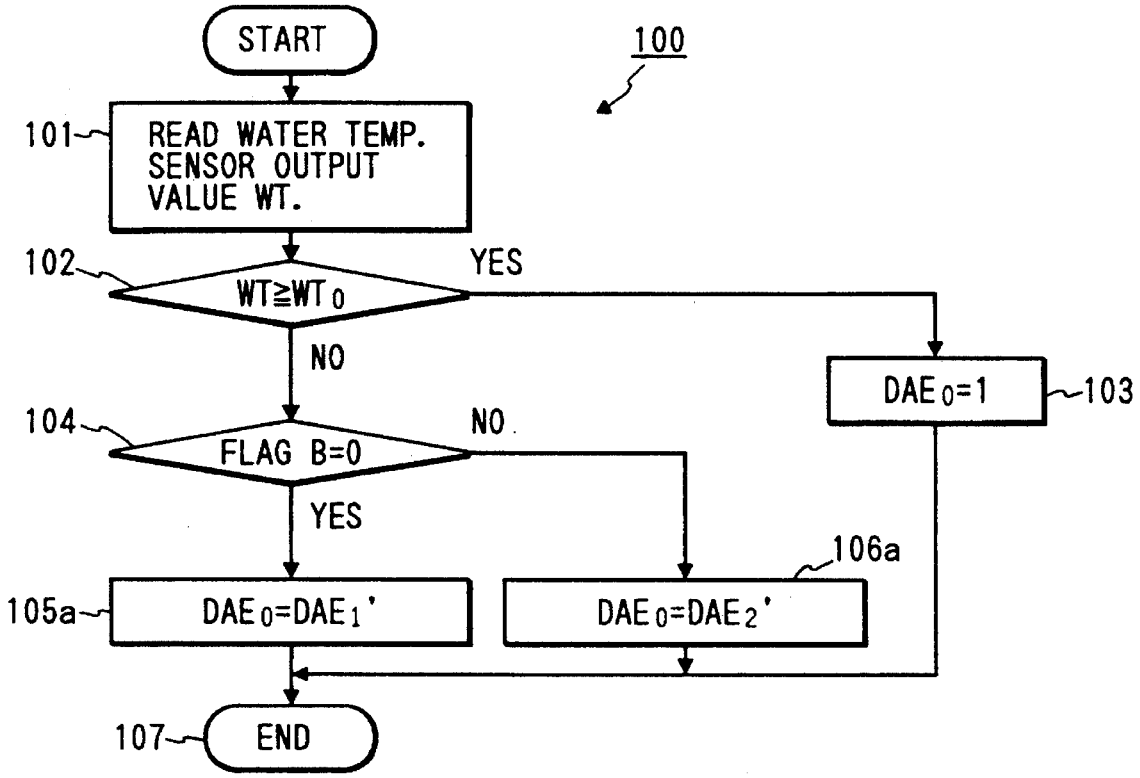
FIGS. 8 is a flowchart showing a main routine to be performed by a control section of a fuel injection device for an engine according to a third embodiment.
Figure 9:
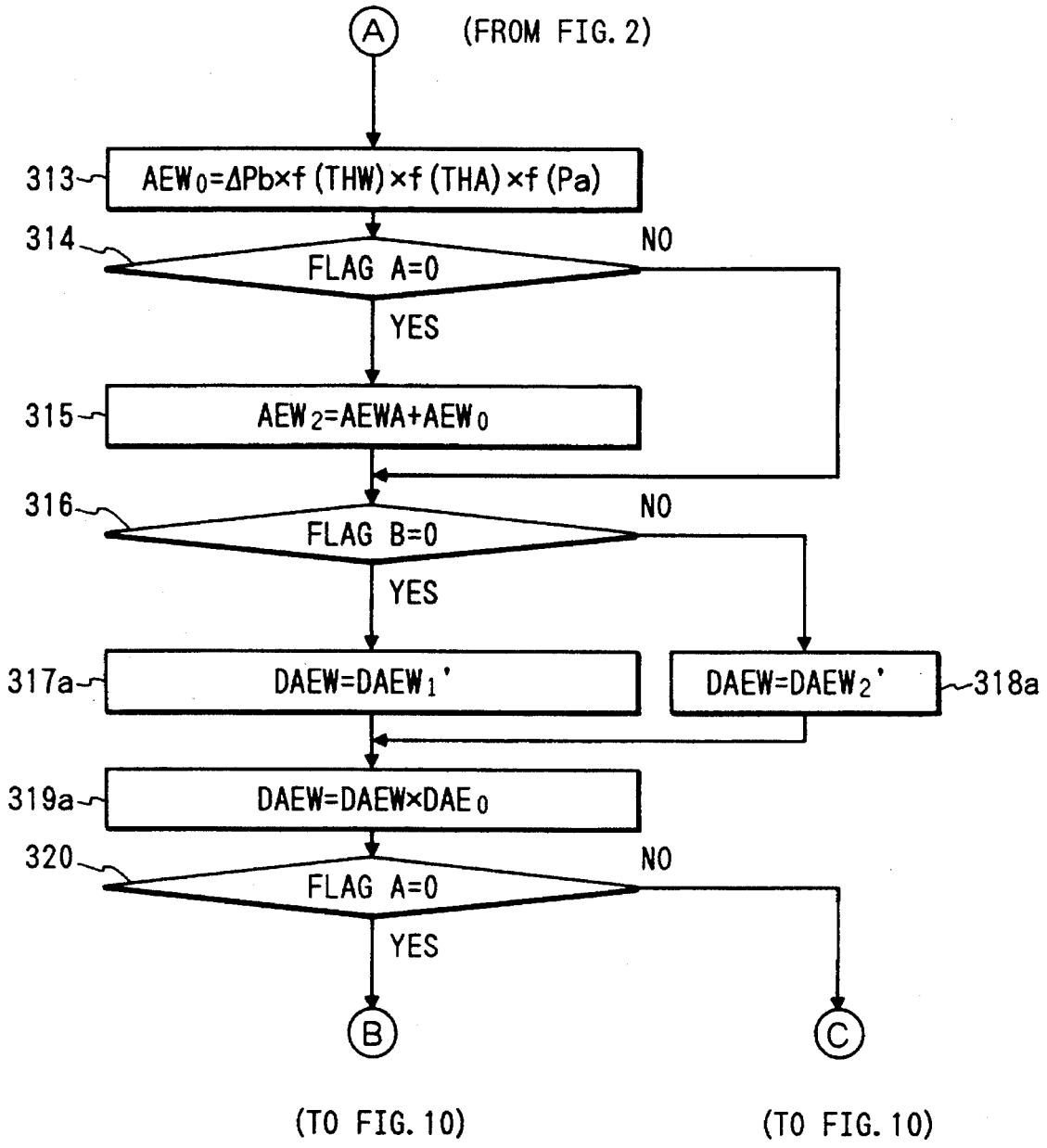
FIGS. 9 and 10 constitute a flowchart showing a predetermined crank angle routine to be performed by the control device in the third embodiment.
Figure 10:
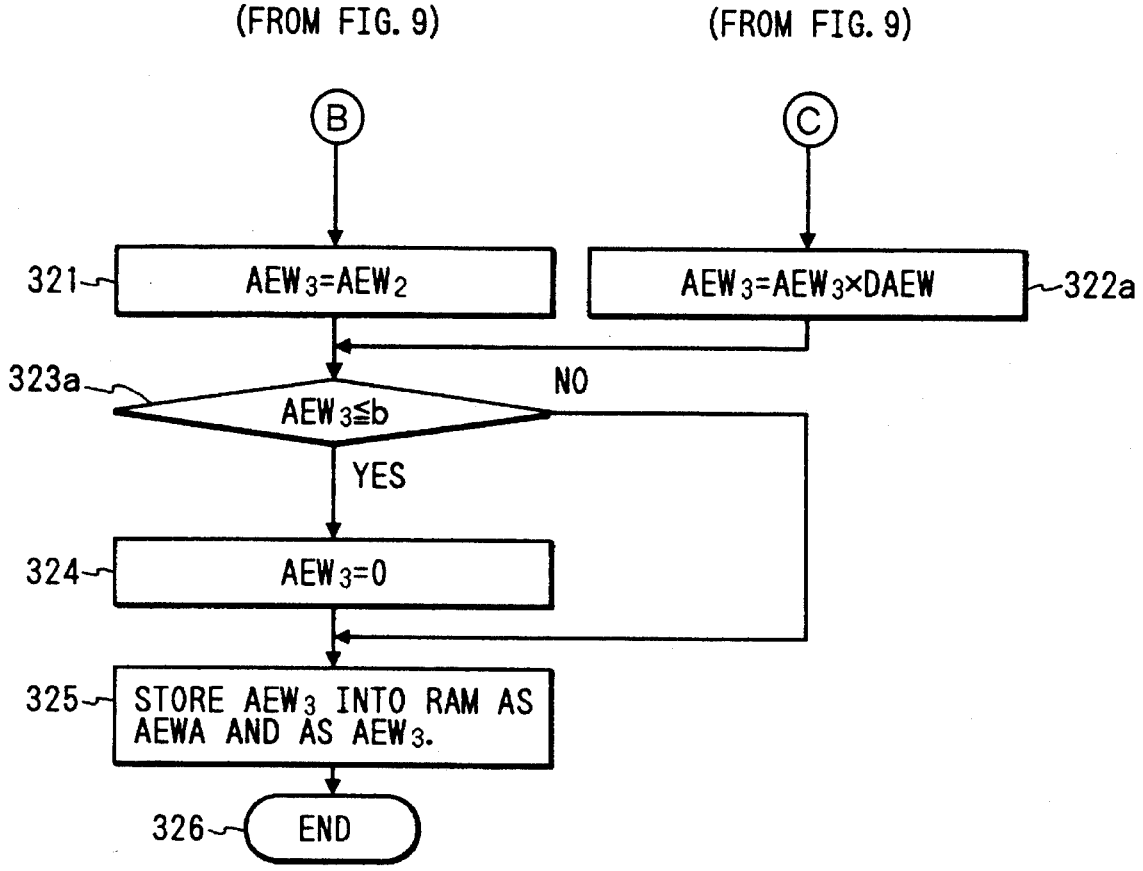

While in the first and second embodiments the fuel injection amount decreasing means uses subtraction, in the third embodiment it uses multiplication as shown in FIGS. 8–10. FIGS. 8–10 correspond to FIGS. 1, 3 and 4, respectively, and steps 317*a*, 318*a*, 319*a*, 322*a* and 323*a* serve to perform the decreasing operation using multiplication instead of subtraction. First and second multiplication constants $DAEW_1'$ and $DAEW_2'$ given in steps 317*a* and 318*a*, respectively are set such that $0<DAEW_1'<1$, $0<DAEW_2'<1$ and $DAEW_1'<DAEW_2'$. Coefficients $DAE_1'$ and $DAE_2'$ given in steps 105*a* and 106*a*, respectively are set such that $1<DAE_2'<DAE_1'$, $DAEW_1' \times DAE_1' <1$ and $DAEW_2' \times DAE_2'<1$. In step 322*a*, multiplication is performed instead of subtraction. Since $AEW_3$ does not become less than or equal to 0 in the case of multiplication, if the correction coefficient $AEW_3$ is judged to be less than or equal to a predetermined value b in step 323*a*, it is set at 0 in step 324.

Embodiment 4

In the first to third embodiments, the fuel injection system is a speed density type fuel injection device. In a fourth embodiment, the fuel injection system is a fuel injection device or an electronically controlled carburetor based on the internal pressure of an intake pipe or a parameter corresponding thereto (e.g., an intake air amount Qa divided by a speed of engine rotation N) and using an air flow sensor.

As described above, according to the invention, the fuel injection amount is increased in accordance with the degree of acceleration when the engine is causing acceleration of a higher degree than a predetermined level. Further, after the end of acceleration, the fuel injection amount is decreased from the level of the acceleration end with the gradient that is in accordances with the degree of acceleration in the above increasing operation, and the decreasing gradient is corrected in accordance with the engine temperature. Therefore, the acceleration fuel correction period can be optimized over a wide acceleration range of quick acceleration to slow acceleration and over a wide engine temperature range of a low temperature to high temperature. Since the fuel control accuracy in acceleration is kept high, there can be obtained acceleration performance which can provide good feeling of acceleration to a driver.

What is claimed is:

1. An electronically controlled fuel injection device for an engine, comprising:

first judging means for judging whether the engine is in an acceleration state of a degree higher than a predetermined degree;

means for increasing a fuel injection amount at a rate in accordance with the degree of acceleration when the first judging means judges that the engine is in the acceleration state of the degree higher than the predetermined degree; and means for decreasing the fuel injection amount from a level of an end of the acceleration state with a decreasing gradient that is set in accordance with the degree of acceleration so as to be larger when the acceleration degree is higher.

2. The device of claim 1, further comprising second judging means for judging whether the engine is in a quick acceleration state when the first judging means judges that the engine is in the acceleration state of the degree higher than the predetermined degree, wherein the decreasing means decreases the fuel injection amount with a first decreasing gradient when the second judging means judges that the engine is in the quick acceleration state and with a second decreasing gradient smaller than the first decreasing gradient when the second judging means judges that the engine is not in the quick acceleration state.

3. The device of claim 1, wherein the decreasing gradient is so set as to continuously change with respect to the degree of acceleration.

4. The device of claim 1, wherein the first judging means judges based on a variation in a predetermined time interval of a signal representing a load state of the engine.

5. The device of claim 1, further comprising means for detecting a first temperature representing a temperature of the engine, and means for correcting the decreasing gradient in accordance with the detected first temperature so as to be larger when the detected first temperature is higher.

6. The device of claim 5, wherein the correcting means sets the decreasing gradient at a first decreasing gradient when the detected first temperature is higher than a predetermined temperature and at a second decreasing gradient when the detected first temperature is not higher than the predetermined temperature.

* * * * *